US007654440B2

(12) United States Patent
Quaintance et al.

(10) Patent No.: US 7,654,440 B2
(45) Date of Patent: Feb. 2, 2010

(54) OCTAGONAL BULK BIN WITH SELF-LOCKING WEBBED BOTTOM FLAPS

(75) Inventors: Benjamin W. Quaintance, Germantown, TN (US); Mark A. Wisecarver, Morristown, TN (US)

(73) Assignee: International Paper Co., Memphis, TN (US)

( * ) Notice: Subject to any disclaimer, the term of this patent is extended or adjusted under 35 U.S.C. 154(b) by 506 days.

(21) Appl. No.: 11/512,864

(22) Filed: Aug. 29, 2006

(65) Prior Publication Data

US 2007/0131746 A1 Jun. 14, 2007

Related U.S. Application Data

(60) Provisional application No. 60/712,236, filed on Aug. 29, 2005.

(51) Int. Cl.

| | |
|---|---|
| ***B65D 5/00*** | (2006.01) |
| ***B65D 5/08*** | (2006.01) |
| ***B65D 5/10*** | (2006.01) |
| ***B66D 5/24*** | (2006.01) |

(52) U.S. Cl. ..... 229/109; 229/157; 229/184; 229/185; 229/186; 229/920; 229/930; 229/137

(58) Field of Classification Search ..... 229/109, 229/156, 157, 920, 930, 931, 184, 188, 185, 229/137, 186; 206/386
See application file for complete search history.

(56) References Cited

U.S. PATENT DOCUMENTS

| | | | | |
|---|---|---|---|---|
| 4,702,408 | A | 10/1987 | Powlenko | |
| 5,139,196 | A * | 8/1992 | Fry et al. | 229/157 |
| 5,628,450 | A * | 5/1997 | Cromwell et al. | 229/109 |
| 5,752,648 | A * | 5/1998 | Quaintance | 229/109 |
| 5,772,108 | A | 6/1998 | Ruggiere et al. | |
| 5,816,483 | A * | 10/1998 | Gasper | 229/109 |
| 6,074,331 | A * | 6/2000 | Ruggiere et al. | 493/89 |
| 6,220,508 | B1 * | 4/2001 | Wisser | 229/185 |
| 6,371,363 | B1 | 4/2002 | Franklin et al. | |
| 6,588,651 | B2 * | 7/2003 | Quaintance | 229/109 |
| 6,783,058 | B2 | 8/2004 | Quaintance | |
| 2003/0116615 | A1 | 6/2003 | Hyatt et al. | |

* cited by examiner

*Primary Examiner*—Gary E Elkins
*Assistant Examiner*—Latrice Byrd
(74) *Attorney, Agent, or Firm*—Matthew M. Eslami; Dennis H. Lambert

(57) ABSTRACT

An octagonal bulk bin has sidewalls, end walls and diagonal corner panels interposed between adjacent sidewalls and end walls. Major bottom flaps are foldably joined to a bottom edge of the sidewalls, minor bottom flaps are foldably joined to a bottom edge of the end walls, and diagonal bottom flaps are foldably joined to a bottom edge of the diagonal corner panels. A cut separates each major bottom flap from an adjacent diagonal bottom flap, and a web panel connects adjacent side edges of the minor bottom flaps and diagonal bottom flaps. According to one aspect of the invention, each diagonal bottom flap, web panel, and portion of an adjacent major bottom flap are crushed. According to another aspect of the invention, differently shaped notches in a free edge of the minor flaps form locking tabs that are engaged in slots near a free edge of the major flaps.

22 Claims, 9 Drawing Sheets

80

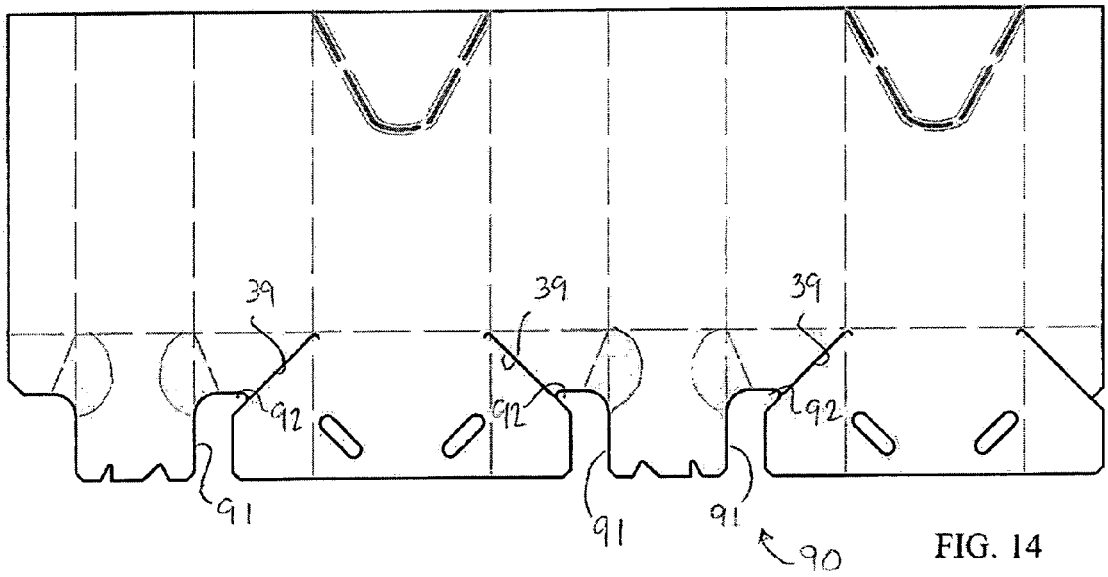
FIG. 14
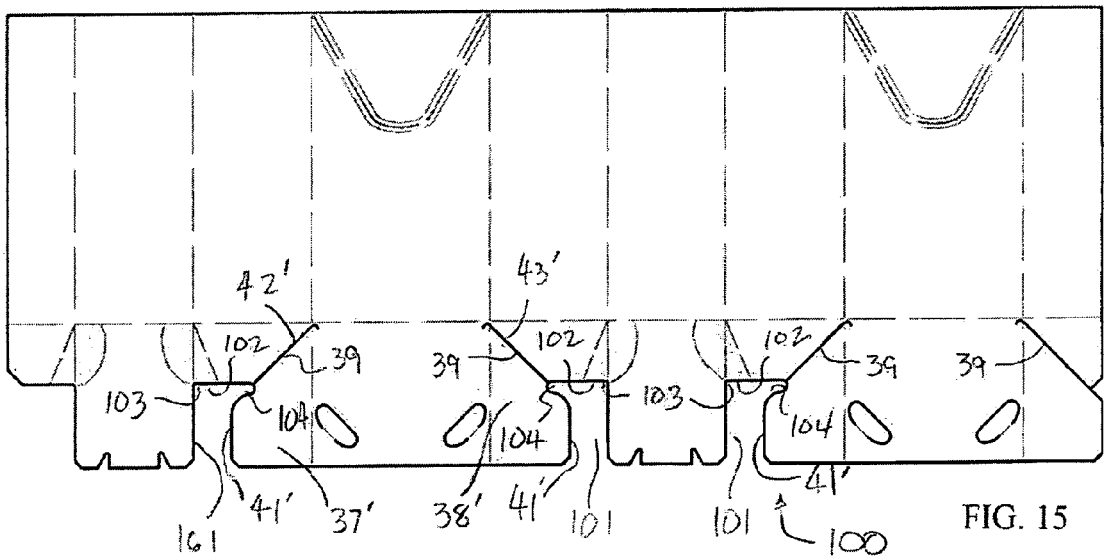
FIG. 15
FIG. 16
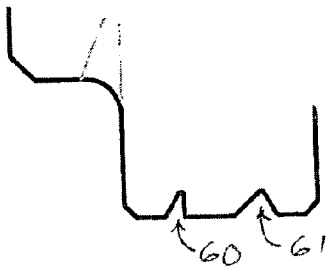

OCTAGONAL BULK BIN WITH SELF-LOCKING WEBBED BOTTOM FLAPS

This application claims the benefit of U.S. provisional patent application Ser. No. 60/712,236, filed Aug. 29, 2005, the entire disclosure of which is incorporated herein by reference.

BACKGROUND OF THE INVENTION

1. Field of the Invention

This invention relates to bulk bins, and particularly to a self-locking bottom flap construction for octagonal bulk bins.

2. The Prior Art

Bulk bins are used in the industry for storing and shipping numerous products, and typically hold 2,000 pounds or more of the product, including flowable or semi-liquid products such as, e.g., comminuted poultry. When flowable products are to be contained in the bin, a bag normally is placed in the bin for receiving the product. The outward force exerted on the sidewalls by flowable products, in particular, is substantial, and tends to bulge the sidewalls outwardly. The bins are commonly made of corrugated cardboard and comprise a plurality of sidewalls joined together along vertical folds. The bottoms of the bins preferably are closed or partially closed by inwardly folded bottom flaps joined to bottom edges of the side walls along horizontal folds. The flaps are separated from one another by slots or cuts extending from an outer edge of the flaps to a point at or near the intersection of the vertical and horizontal folds. This structure creates a weak point where tearing of the vertical fold can initiate. Tearing of the vertical fold can propagate rapidly upwardly, resulting in bursting of the sidewall and failure of the bin, with consequent loss of the stored product.

At least partially to minimize the outward bulge of the sidewalls, the industry has adopted bulk bins having an octagonal shape, wherein diagonal corner panels are interposed between adjacent edges of the opposed sidewalls and opposed end walls. In conventional octagonal bins the diagonal corner panels are of less width than either the sidewalls or the end walls of the bin, and although the octagonal configuration reduces the width of the sidewalls and/or end walls in a bin having a comparable capacity and size to a corresponding four-sided bin, thus reducing the extent of outward bulge of the sidewalls and/or end walls, the sidewalls and/or end walls still have substantial width.

Bulk bins made of corrugated material are typically manufactured from a single blank that is scored to delineate the sidewalls, end walls, diagonal corner panels, and bottom flaps. The blank is folded and secured at a manufacturer's joint by the manufacturer, and shipped to the user in a flattened condition. The user then sets the flattened bin on end and opens it up into an expanded tubular configuration. The bottom flaps are then folded inwardly and secured to hold the bin in its set-up condition. Self-locking bottom flaps have been developed to facilitate setting up the bin from its flattened condition to its fully open usable condition.

Octagonal bulk bins normally have eight bottom flaps, including two major flaps, two minor flaps, and four diagonal flaps. Conventional octagonal bulk bins with or without self-locking bottom flaps are cumbersome to assemble, and as a result users often seek alternative packaging. Further, the sequence of inward folding of the bottom flaps on a conventional octagonal bulk bin frequently results in creating extra pinch points in the bottom of the bin, e.g., by the diagonal flaps extending into the interior of the box bottom, which can damage the bag and cause it to rupture, thus contaminating the stored product.

It would be desirable to have a bulk bin that has all the advantages of an octagonal bulk bin, but that is free of the problems associated with conventional bulk bins, and particularly to have an octagonal bulk bin with bottom flaps, especially self-locking bottom flaps, that is relatively easy to erect into its operative position, is constructed to avoid the formation of weak points where tearing of the vertical fold can initiate and to avoid the formation of pinch points in the bottom.

SUMMARY OF THE INVENTION

The present invention comprises a bulk bin with self-locking bottom flaps constructed so that the bin is relatively easy to erect, and which avoids the formation of weak points where tearing of the vertical fold can initiate, and avoids the formation of pinch points in the bottom.

The bulk bin of the invention is an octagonal bin, erected from a single unitary blank, with opposed sidewalls, end walls, and diagonal corner walls or panels interposed between adjacent side and end walls, said walls being connected together along vertical folds at their adjacent side edges. The sidewalls generally have a greater width than the end walls, and in a preferred embodiment the end walls and diagonal walls have the same width, thus reducing the width of the sidewalls and end walls in a bin having a comparable capacity, and thereby reducing outward bulge of the sidewalls and/or end walls, although the invention has equal applicability in a bin having diagonal walls that are narrower than the end walls. A major bottom flap is foldably joined to the bottom edge of each sidewall, a minor bottom flap is foldably joined to the bottom edge of each end wall, and a diagonal bottom flap is foldably joined to the bottom edge of each diagonal wall, said flaps being foldably joined to the respective walls along horizontal folds substantially perpendicular to the vertical folds. The major and minor flaps typically have the same width (as used herein with reference to the flaps, "width" refers to the distance between the free edge of the flap and its folded connection with a respective wall), but the width of the diagonal flaps is substantially less. The major flaps have generally trapezoidally shaped extensions projecting from their opposite side edges and these extensions are separated from adjacent diagonal flaps by angled cuts extending from an outer edge of a respective diagonal flap to a point near the juncture of an adjacent vertical fold and the horizontal fold for that major flap. Material is cut from between adjacent side edges of the major and minor flaps in the area located beyond the free edge of an associated diagonal flap so that these edges are spaced from one another.

The bottom flaps in the bin of the invention are self-locking, and web panels are connected between adjacent edges of the diagonal flaps and the respective adjacent minor bottom flaps, whereby the diagonal flaps automatically fold inwardly when the minor flaps are folded in, so that the user has to fold only four bottom flaps inwardly (the two major flaps and the two minor flaps), in contrast to the requirement to fold eight bottom flaps inwardly on conventional octagonal bins (the two major flaps, the two minor flaps, and four diagonal flaps).

Since the major flaps in the bin of the invention are separated from adjacent diagonal flaps by cuts, the major flaps can be folded inwardly independently of movement of the diagonal flaps or minor flaps, making the major flaps easier to fold and avoiding tearing of the diagonal flap panels due to stress imposed on them by folding of the major flaps, as occurs in those constructions in which the major flaps are connected by a gusset or web panel to the diagonal flaps. Further, the cuts or slits separating the major bottom flaps from adjacent diagonal flaps terminate in spaced relationship to the horizontal and vertical folds delineating the side walls, thereby eliminating the weak points where tearing of the vertical folds can initiate. The construction and sequence of folding of the bottom flaps also avoids the formation of pinch points, since the diagonal flap panels are disposed between the major flaps and the minor flaps and none of the diagonal panels are exposed inside the bin. In conventional constructions the diagonal flaps can be disposed above the major flaps and inside the bin, forming potential pinch points that can cause tearing of a bag placed inside the bin to contain products having greater fluidity.

Notches cut in the ends of the minor bottom flaps form a pair of locking tabs on each minor bottom flap, and angled slots cut in the major bottom flaps adjacent their outer edge form openings for receiving the locking tabs. The two major bottom flaps are first folded inwardly to square up the bin, followed by inward folding of the minor bottom flaps. Since the diagonal flaps are connected by web panels or gussets to adjacent edges of the minor bottom flaps, inward folding of the minor bottom flaps into their operative inwardly folded position also causes the diagonal flaps to fold inwardly, with a portion of the diagonal flaps sandwiched between the major and minor flaps. By pressing the inwardly folded minor flaps downwardly against the previously inwardly folded major flaps, the locking tabs on the minor bottom flaps engage in the slots in the major bottom flaps to lock the bottom flaps in position and thus hold the bin in its setup condition.

In one embodiment of the invention the major bottom flaps can have a combined width slightly greater than the width of the bin so that the major flaps overlap at their free edges when they are fully inwardly folded to close the bottom of the bin. In accordance with the invention, the notches cut in the ends of the minor flaps are shaped so that when the minor flaps are pressed down against previously folded major flaps during set up to insert the locking tabs into the slots, and then released to enable the flaps to spring back up to a generally horizontal, interlocked position, clearance is provided to enable one major flap to rise above the other so that one of the major flaps will overlie the other as they return to their interlocked horizontal position. Without this feature, it is possible for the free edges of the major flaps to abut one another when pressure is released, preventing the overlap and causing the abutting major flaps to tend to spread apart the bottom of the bin.

In another embodiment, the major bottom flaps do not overlap but instead have a combined width substantially equal to the width of the bin and butt against one another at their free edges when they are in their inwardly folded, generally horizontal positions. In these bins the notches in the free edges of the minor flaps can be identical, mirror images of one another so that when downward pressure against the minor flaps is released, both major flaps spring upward equally so that when the flaps return to a generally horizontal position the free edges of the major flaps abut one another, effectively closing the bottom of the bin.

To facilitate predetermined folding of the diagonal flaps, a strategically placed angled fold score is made in the diagonal flaps, extending from a point near where the vertical and horizontal folds for the adjacent minor flap intersect to the end of the cut-out that separates the major and minor flaps.

The diagonal flaps and portions of the minor flaps are crushed in a predetermined pattern to provide clearance for the overlapping flap material when the flaps are operatively engaged to close the bottom of the bin, and to prevent formation of false scores or folds as the flaps are folded inwardly. More specifically, all of the material of the diagonal flap lying between the angled fold score and the angled cut separating diagonal flap from the adjacent major flap is lightly crushed, and the balance of the diagonal flap and a portion of the adjacent minor flap is more heavily crushed, with the edge of the crushed area lying in the minor flap having an arcuate shape.

Further, in a preferred form of the invention a parabolic crease or score is made in each sidewall in a top portion thereof to produce predictable and controlled buckling or bulging of the sidewall as the result of pressure exerted on the sidewalls by product in the bin.

The bulk bin of the invention can be of single wall, double wall or triple wall construction, with or without sesame tape or strap reinforcing, and stretch wrap can be easily applied.

The bulk bin of the invention can be used with a conventional wooden pallet, or a slip sheet, or can be set directly on a floor surface. Further, applicant has developed a plastic pallet tray for use with octagonal bulk bins, and especially when this pallet tray is used with the bulk bin of the invention it is contemplated that the bins can be stacked on top of one another, something that cannot be done with conventional octagonal bulk bins. Moreover, the plastic pallet tray serves as a jig to facilitate setup of the octagonal bulk bin, and prevents contact between the top of the bin and a floor surface, thereby reducing or eliminating contamination issues. The pallet tray is lightweight and nestable for economy in storage and shipping, is reusable, and has two-way accessibility for a hand jack and four-way accessibility for a fork lift. Although shown and described herein as used with the octagonal bulk bin of the invention, it should be understood that the plastic pallet tray has equal utility with conventional octagonal bulk bins, and with appropriate modification can be used with four-sided bins.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein:

FIG. 14 is a plan view of an alternate embodiment of a blank for making a bin having overlapping bottom flaps, wherein the cut-outs between the major and minor flaps have a different terminal end shape.

FIG. 15 is a plan view of a further alternate embodiment of a blank for making a bin having non-overlapping bottom flaps, with symmetrically shaped notches in the ends of the minor flaps, and wherein the cut-outs between the major and minor flaps have yet another different terminal end shape.

FIG. 16 is an enlarged fragmentary plan view of a portion of a blank as shown in FIG. 15, depicting a modification thereof in which the notches in the minor flaps are non-symmetrical for bins with overlapping bottom flaps.

DETAILED DESCRIPTION OF PREFERRED EMBODIMENTS

Figure 1:
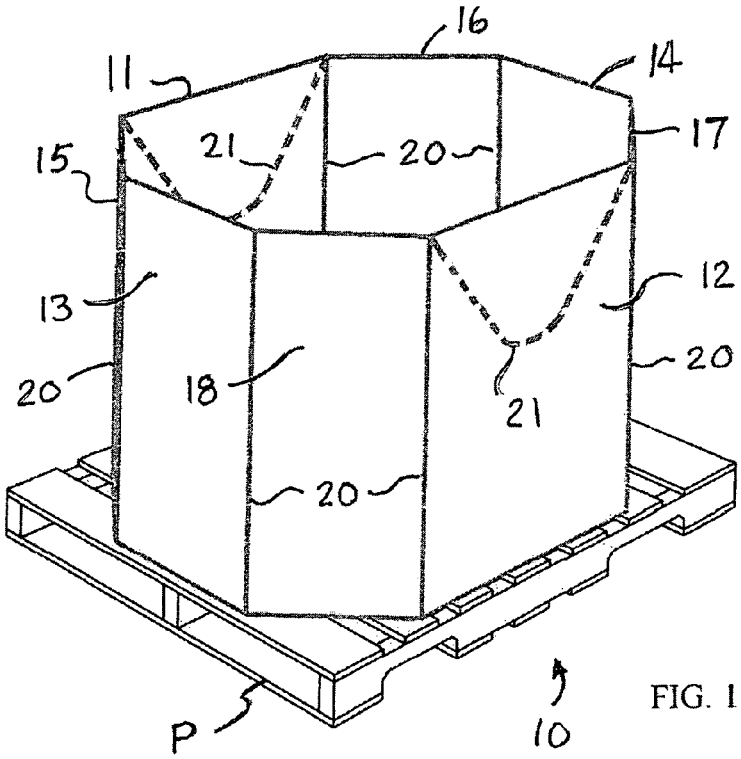
FIG. 1 is a top perspective view of one embodiment of an octagonal bulk bin according to the invention, wherein the diagonal corner panels have the same width as the end wall panels, and the bin is shown on a conventional wooden pallet.
Figure 3:
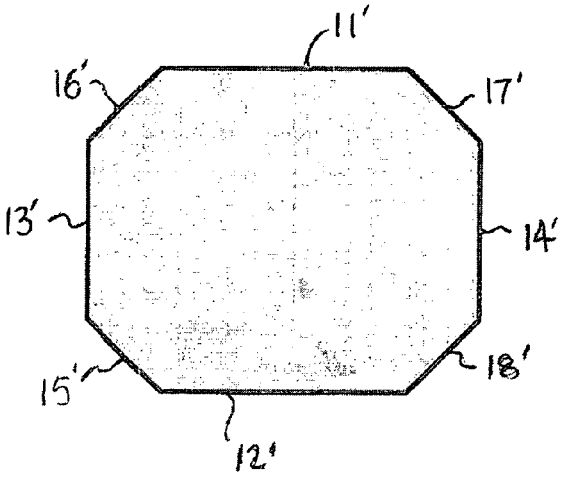
FIG. 3 is a plan view of the footprint of a bin wherein the corner panels have less width than the end walls.
Figure 2:
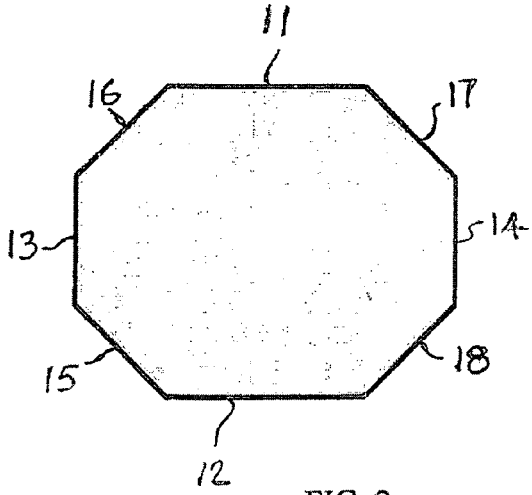
FIG. 2 is a plan view of the footprint of a bin wherein the end walls and corner panels have the same width.

An octagonal bulk bin in accordance with the invention is indicated generally at 10 in the drawings, and comprises opposite parallel sidewalls 11 and 12, opposite parallel end walls 13 and 14, and diagonal corner panels 15, 16, 17 and 18 interposed between respective side and end walls. The side and end walls and the diagonal corner panels are joined along vertical folds 20. In the preferred embodiments, shown in FIGS. 1, 2, 4-11, 14 and 16, the diagonal corner panels have the same width as the end walls, and parabolic creases 21 are formed in the sidewalls 11 and 12 to obtain predictable and controlled buckling of the sidewalls when internal pressure is applied to the sidewalls by the contents of the bin. As shown in the particular embodiments described herein, the creases 21 are formed by a score line bordered by crushing on both sides. The operation of the creases 21 and of the equal width end walls and diagonal corner panels is more fully explained in applicant's prior U.S. Pat. No. 6,783,058. It should be understood, however, that neither equal width end walls and diagonal corner panels, nor the parabolic creases are essential to the present invention, but either or both do enhance performance of the bin. Further, the bin in FIG. 1 is shown as supported on a conventional wooden pallet P, but it should be understood that a pallet such as shown in applicant's prior provisional application Ser. No. 60/712,236 could be used. The type of pallet, or whether any pallet is used, is not important to the present invention.

Figure 4:
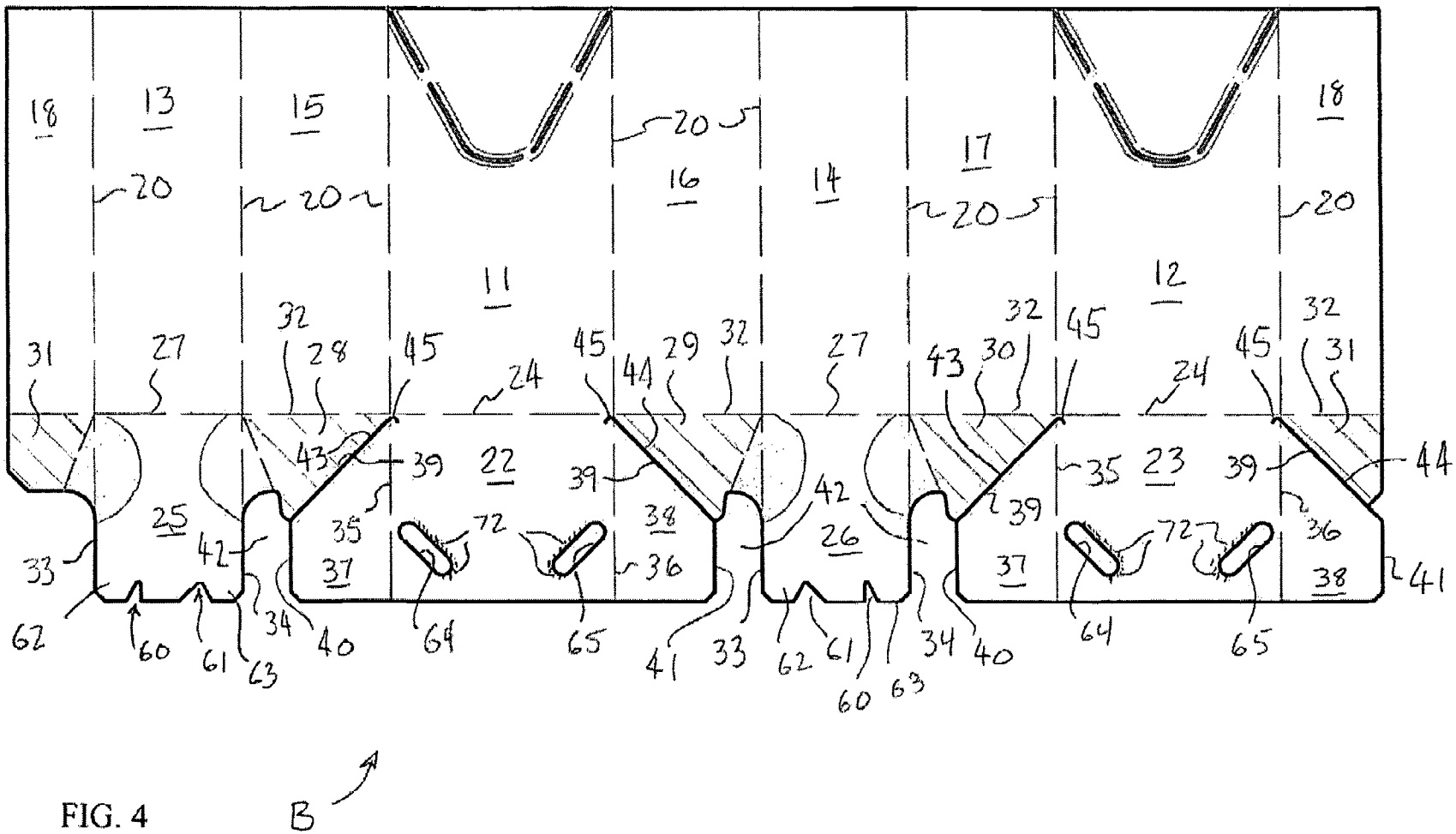
FIG. 4 is a plan view of a blank for making a bin according to a preferred embodiment of the invention, wherein the corner panels have the same width as the end wall panels, and parabolic creases are formed in the sidewalls.

The bin is made from a single unitary blank B, and with reference to FIG. 4, major bottom flaps 22 and 23 are foldably joined to bottom edges of the respective sidewalls along horizontal folds 24 extending perpendicular to the vertical folds 20, minor bottom flaps 25 and 26 are foldably joined to bottom edges of respective end walls along horizontal fold lines 27, and diagonal bottom flaps 28, 29, 30 and 31 are joined to respective diagonal corner panels along horizontal folds 32. The major and minor bottom flaps are equally wide between their respective folds and free edges, and have lengths in a side-to-side direction that correspond to the width of a respective sidewall or end wall, with the minor flaps 25 and 26 having opposite side edges 33 and 34 aligned with the vertical folds 20 delineating a respective associated end wall, and the major flaps 22 and 23 having opposite sides defined by creases 35 and 36 aligned with the vertical folds 20 delineating a respective sidewall. Thus, in an octagonal bin having sidewalls that are wider than the end walls, as in the embodiments shown herein, the major bottom flaps are longer side-to-side than the minor bottom flaps. Further, the diagonal bottom flaps 28, 29, 30 and 31 have a width between their respective folds 32 and free edges that, in the particular embodiments shown, is less than about ½ the width of the major and minor flaps. It should be noted that this dimensional relationship is at least partially dependent upon the respective widths of the sidewalls, end walls and diagonal corner panels, and can vary depending upon this and other factors.

The major flaps 22 and 23 have trapezoidally shaped extensions or wings 37 and 38 projecting laterally from the creases 35 and 36, and the extensions are separated from respective adjacent diagonal flaps 28, 29, 30 or 31 by cuts 39 extending at about a 450 angle from a point near the intersection of the folds 24 with a respective crease 35 or 36, to a point about mid way along the opposite side edges 40 and 41 of the major flap extensions, and by shaped cut-outs 42 that space edges 40 and 41 from adjacent edges 33 and 34 of the minor flaps. The side edges of the major flaps therefore include edge portions 43 and 44 that extend at about a 450 angle relative to vertical folds 20 and edge portions 40 and 41 that extend parallel to vertical folds 20. The cuts 39 terminate in a J-shaped hook 45 at their ends adjacent but spaced a slight distance "d" from the folds 24 and pointing away from both the horizontal and vertical folds, with a convex side adjacent the intersection of the horizontal and vertical folds and a free end in an adjacent major bottom flap pointing away from said intersection and into said major bottom flap to redirect stress away from said horizontal and vertical folds and to avoid initiation of a tear in the vertical fold. While superior performance is obtained with the J-shaped cut shown, it is to be understood that other shapes could be employed, so long as stress along cut 39 is redirected away from the horizontal fold 24 and especially away from the vertical fold 20. For example, the cut could be shaped as a modified Greek letter psi, or an inverted modified Greek Jetter psi, or a T, L, U, V, etc as described in applicant's commonly owned prior U.S. application Ser. No. 10/316,966, filed Dec. 11, 2002.

The length of the extensions 37 and 38 between the creases 35 and 36 and the edges 40 and 41, and the shape of the extensions as defined by the cuts 39 and cut-outs 42, are such that the extensions closely fit in the interior space or corners of a bin erected from the blanks shown in the figures. See, e.g., FIGS. 7 and 11.

Figure 5:
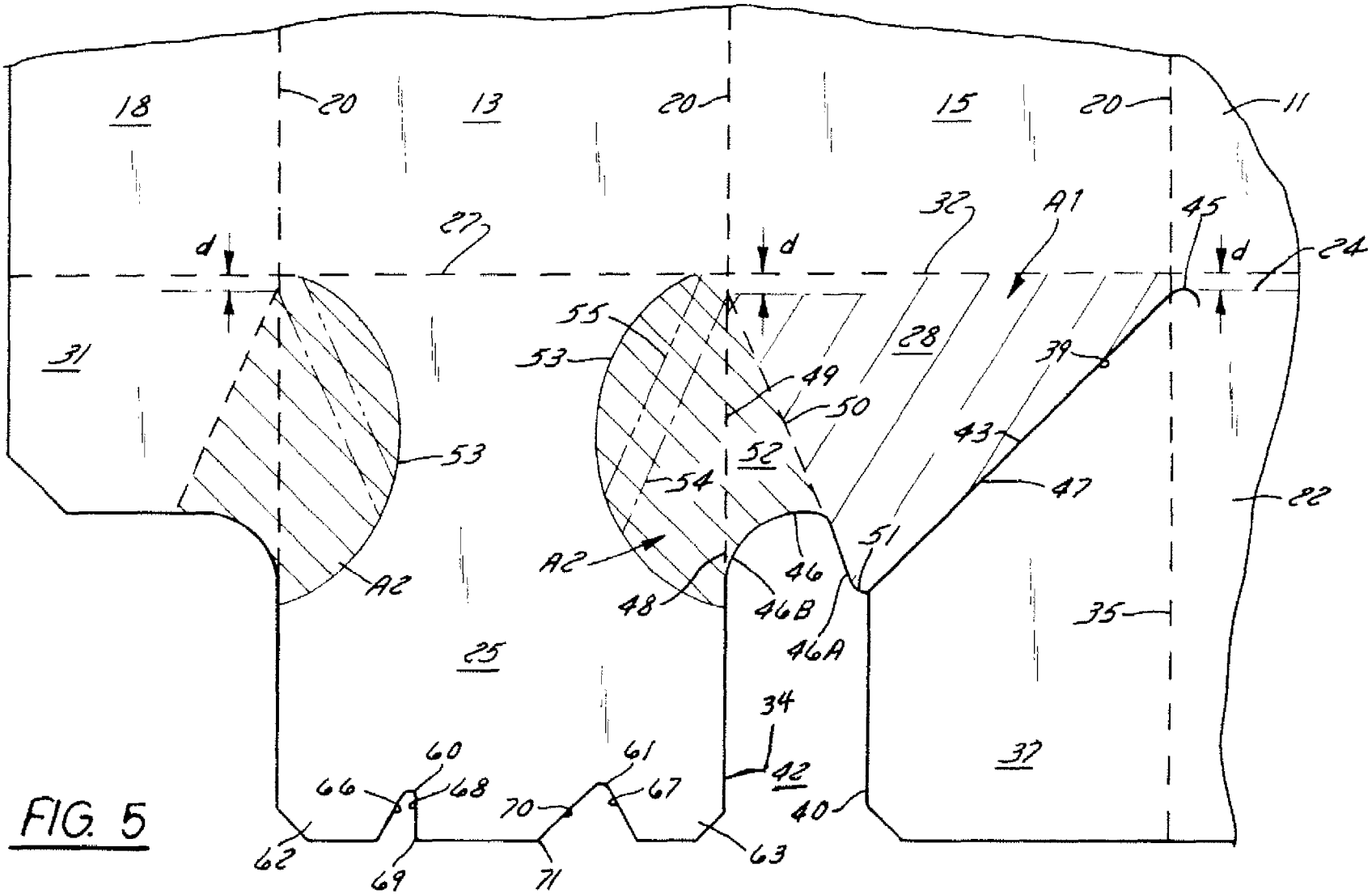
FIG. 5 is an enlarged fragmentary plan view of a portion of the blank of FIG. 4, showing details of the invention.
Figure 6:
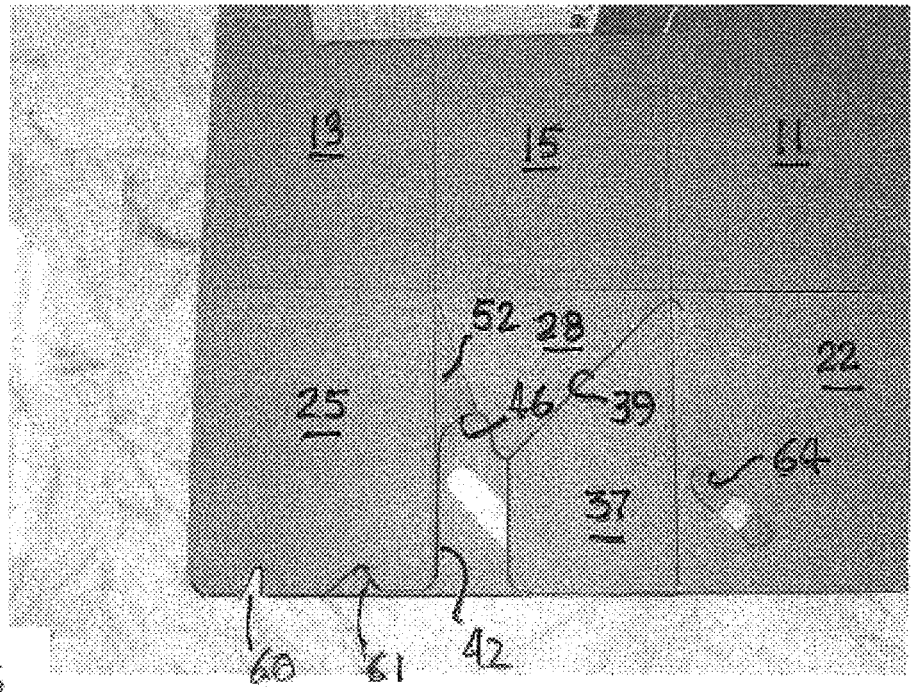
FIG. 6 is a plan view of the blank of FIG. 4, folded in half into a flattened condition for shipment to a user.

As seen best in FIG. 5, the shaped cut-outs 42 terminate at their inner end in a curvilinear configuration that delineates an end edge 46 of the diagonal flap, and the angled cut 39 delineates one side edge 47. The other side edge 48 of the diagonal flap is integrally connected to the adjacent minor flap 25 along a first fold score 49 that is in alignment with the vertical fold 20 joining the associated end wall 13 and diagonal panel 15. A second fold score 50 extends at an angle of about 22.5° relative to the first fold score 49, from a point on the first fold score 49 near but spaced from fold score 27, to the apex of the curved end edge 46. It will be noted that end edge 46 includes a first edge portion 46A extending in general alignment with fold score 50, and terminating in an end 51 that connects to the juncture of edge portions 40 and 43 at an angle that substantially bisects the included angle between edge portions 40 and 43. The end edge 46 includes a second, arcuate edge portion 46B extending between the ends of fold scores 49 and 50, with one end of the arcuate edge extending substantially perpendicular to the fold score 50, and the other end of the arcuate edge extending substantially tangentially to the fold score 49. The fold scores 49 and 50 define a web 52 that connects the diagonal flap with the minor flap.

The area A1 of diagonal flap 28 bounded by edges 46A and 47 and folds 32 and 50 preferably is lightly crushed as indicated by the diagonal cross-hatching, and a second area A2 bounded by fold score 50 in diagonal flap 28 and arcuate edge 53 lying in minor flap 25 is more heavily crushed, as indicated by more closely spaced cross-hatching. Since the machinery used to crush the panels is normally set to deliver a constant force, different degrees of crushing are obtained by using harder or softer press or die elements. Thus, in the present invention the more lightly crushed areas are crushed by using gray sponge rubber elements and the more heavily crushed areas are crushed by using dieprene rubber elements. These shaped crushed areas provide clearance for the overlapped material when the bin is in its operative folded position, providing a flatter, more compact fold. Further, the fold score 49 and fold line 50, and especially the crushed area A2, with its arched edge 53, ensure proper operation of the web 52 and prevent propagation of false folds in the panels as the bin is being folded into its operative position.

When lighter materials are used, such as, e.g., single wall or lighter double wall, crushing of area A1 can be omitted and suitable performance still obtained. Moreover, a separate fold score 50 need not be formed by a die blade, but instead the line of transition between the heavily crushed area A2 and the more lightly crushed or non-crushed area A1 can be relied upon for forming a fold line about which the material will fold.

The placement and radius of arcuate edge 53 is determined by drawing an imaginary line 54 that is a mirror image of fold score 50, then drawing a second line 55 parallel to and spaced from line 54 a distance calculated to account for manufacturing tolerances, and swinging an arc (edge 53) that connects the three points defined by the intersection of one end of line 55 with fold 27, the opposite end of line 55, and the point at or near where the fold score 49 terminates at edge 46.

With particular reference to FIGS. 4 and 5, it will be noted that the shaped cut 45 at the end of cut 39, and the point of intersection of fold lines 50 and 49, are spaced a short distance "d" from the respective horizontal folds 24 and 27. This spacing is to accommodate manufacturing tolerances and is to ensure that the cut, especially, will not extend into the panel 11. The crushed areas A1 and A2 preferably do not extend beyond the folds 27 and 32.

A self-locking structure is defined by a pair of triangularly shaped notches 60 and 61 in the free edge of each of the minor bottom flaps, defining a pair of locking tabs 62 and 63 on the corners of the minor bottom flaps, and by a pair of angled slots 64 and 65 formed in the major bottom flaps near their free edge in a position to receive the locking tabs when the major and minor bottom flaps are folded inwardly over the bottom of the bin. To enhance the ease of setting up the bin, the edges of the slots facing toward the centerline of the flap may be crushed as indicated at 72. In those bins where the major flaps are intended to overlap when in their inwardly folded position, as in FIGS. 4-11, one of the notches 61 is shaped differently than the other notch 60. That is, the side edges 66 and 67 lying closest to the respective adjacent side edges of the flap in both notches 60 and 61 extend at an angle of about 60° relative to the free end edge of the flap, but the side edge 68 lying closest to the center of the flap in notch 60 extends substantially perpendicular to the free end edge of the flap, defining an inner shoulder 69, whereas the side edge 70 of notch 61 extends at an angle of about 45° relative to the free end edge of the flap, defining an inner shoulder 71 that is spaced closer to the centerline of the flap than is shoulder 69. Thus, when the minor flap is pushed downwardly against a pair of opposed major flaps during set up of the bin to engage the locking tabs in the slots, and pressure is then released to permit the flaps to spring back up to a generally horizontal position, the shoulder 69 will hold the major flap it engages down farther than will the shoulder 71 hold its associated major flap down. Stated differently, the shoulder 71 is effectively cut away, providing clearance for the major flap engaged thereby to enable that flap to move farther upwardly when downward pressure on the minor flap is released, permitting that major flap to overlie the opposed major flap as they return to a horizontal position. See FIGS. 8-10. It should be understood that the particular angles of the sides of the respective notches are not critical and the sides of the notches can be oriented at any angle, so long as the inner shoulder of one notch is spaced farther from the flap centerline than is the inner shoulder of the other notch in that flap, whereby the inner shoulders of the notches on one side of the centerline of opposed minor flaps will engage and hold down the associated first major flap while the inner shoulders of the other notches in the minor flaps, being spaced closer to the flap centerline, will provide clearance to permit the associated second major flap to at least initially move up farther than the first major flap so that the major flaps will move into overlapping relationship as they approach horizontal positions. Moreover, some shape other than V-shaped notches may be used. The essential point is that one major flap is permitted to initially move up more than the other major flap so that they overlap at their adjacent free edges as they approach their operative folded horizontal positions.

Figure 12:
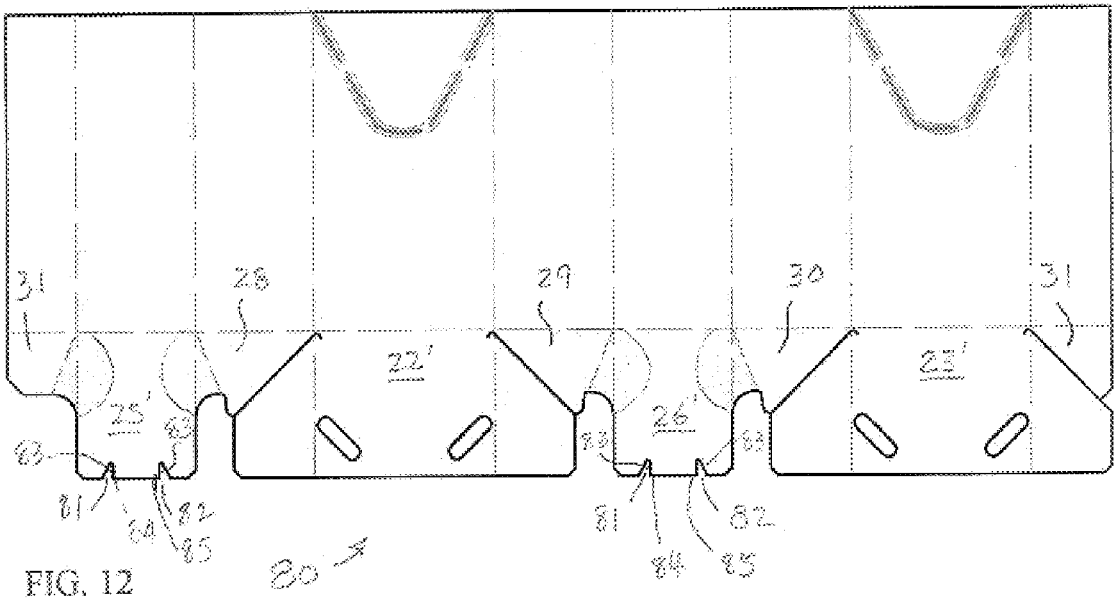
FIG. 12 is a top plan view of a blank for making an alternate embodiment of the bin of the invention, wherein the major bottom flaps do not overlap and the notches in the edge of the minor flaps are identically shaped.
Figure 13:
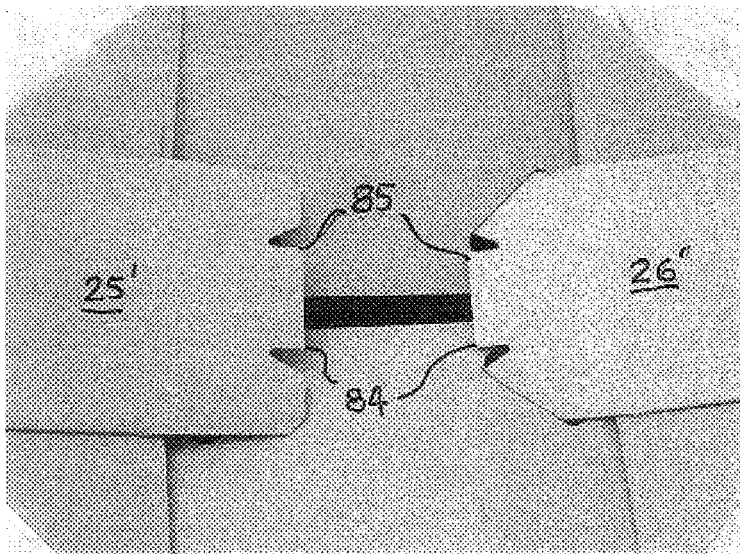
FIG. 13 is a bottom perspective view of a bin made from the blank of FIG. 12, showing how the minor flaps and notches are constructed to react equally against the two major flaps.

FIGS. 12 and 13 show another embodiment 80, in which the bottom flaps 22', 23', 25', 26' and 28'-31' are not as wide as in the previous embodiment and the major bottom flaps 22' and 23' are not intended to overlap, but instead butt against one another at their free edges when they are in their inwardly folded horizontal positions. This form of the invention is identical to the previous form, except that both notches 81 and 82 in the free edge of the minor flaps are identical to one another, and except for the difference in width of the bottom flaps. Thus, the edge 83 of both notches extends substantially perpendicular to the free edge of the flap, and the shoulders 84 and 85 are spaced equally from the center of the flap, whereby the shoulders act to exert substantially equal downward pressure on the major flaps when the box is being set up, and provide substantially equal clearance for return of the major flaps to an upper, horizontal position when pressure is released.

A further embodiment of the invention is indicated at 90 in FIG. 14. This form of the invention is identical to that shown in FIG. 4 except that the cut-outs 91 between the major and minor bottom flaps are shaped slightly differently, in that the cut-out extends at one side a short distance along the diagonal cut 39, forming a "nose" 92 on the end of the cut-out at the end edge of the diagonal flap. This form functions identically to the form shown in FIG. 4, except that due to the extension of the "nose" to one side of the cut-out the waste material may be more difficult to remove when the cut-out is made. It should be understood that this form could be applied to a bin in which the major bottom flaps do not overlap, in which case the bottom flaps would be made narrower, and the notches in the ends of the minor flaps could be shaped identically to one another as shown in FIG. 12.

Another embodiment is shown at 100 in FIG. 15. This form of the invention is identical to the form shown in FIG. 12, except that the cut-out 101 is shaped differently. In this form, the cut-outs are formed essentially of straight lines and form a straight edge 102 on the end of the diagonal flap. At one end this edge intersects the side edge of the minor flap at a right angle 103, and at the other end the edge 102 extends slightly beyond the edge 41' of the major flap, forming a "toe" 104 that protrudes slightly into the edges 42' and 43' of extensions 37' and 38' at the terminal end of diagonal cut 39. This form functions substantially identically to the form shown in FIG. 12, except that the piece of waste material formed by making the cut-out 101 may be harder to remove, and the straight lines and sharp angles are more likely to establish stress points where tearing or propagation of false fold lines (buckling) can occur. This bin could be adapted to one in which the major bottom flaps overlap by making the flaps wider, and, if desired, shaping the notches in the end edge of the minor flaps asymmetrically as shown in FIGS. 4 and 16.

Figure 17:
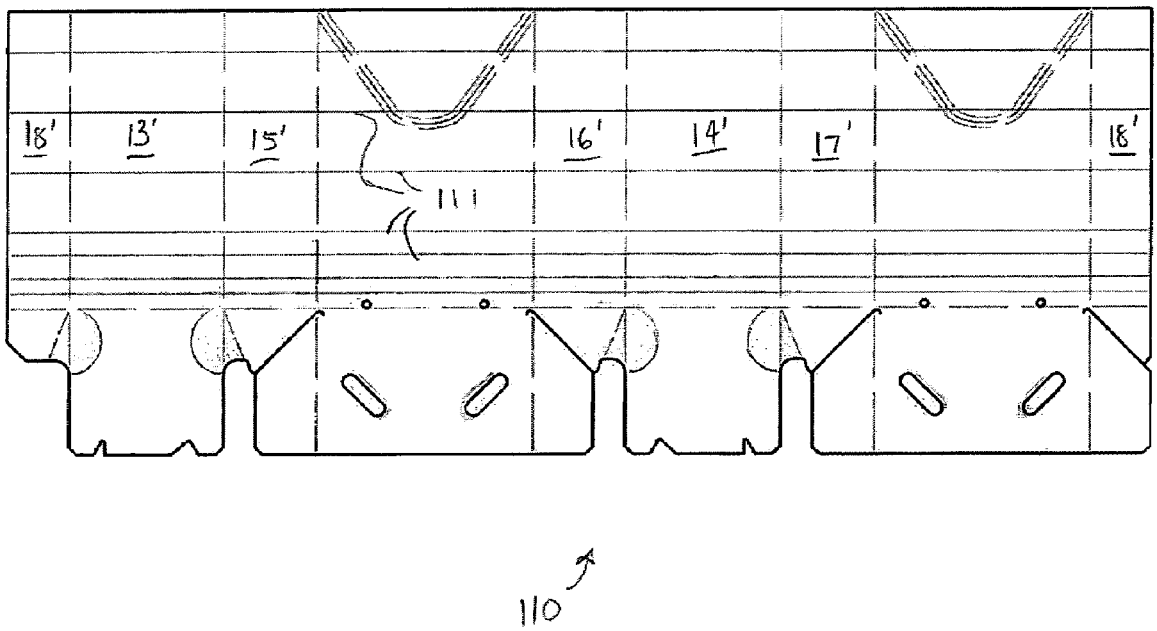
FIG. 17 is a top plan view of a blank having a bottom flap construction as shown in FIG. 4, but wherein the diagonal corner panels are of less width than the end walls, and wherein reinforcing tapes or straps are shown applied to the bin.

FIG. 17 shows an embodiment 110 in which the end wall panels 13' and 14' have a greater width than the diagonal corner panels 15'-18'. In all other respects, except for differences in the side-to-side dimensions of the bottom flaps resulting from differences in the sidewall, end wall and diagonal corner panel widths, this form of the invention is identical to the form shown in FIG. 4. Also shown in this figure is reinforcing tape 111, which can be applied, or not, to any of the forms of the invention.

Figure 7:
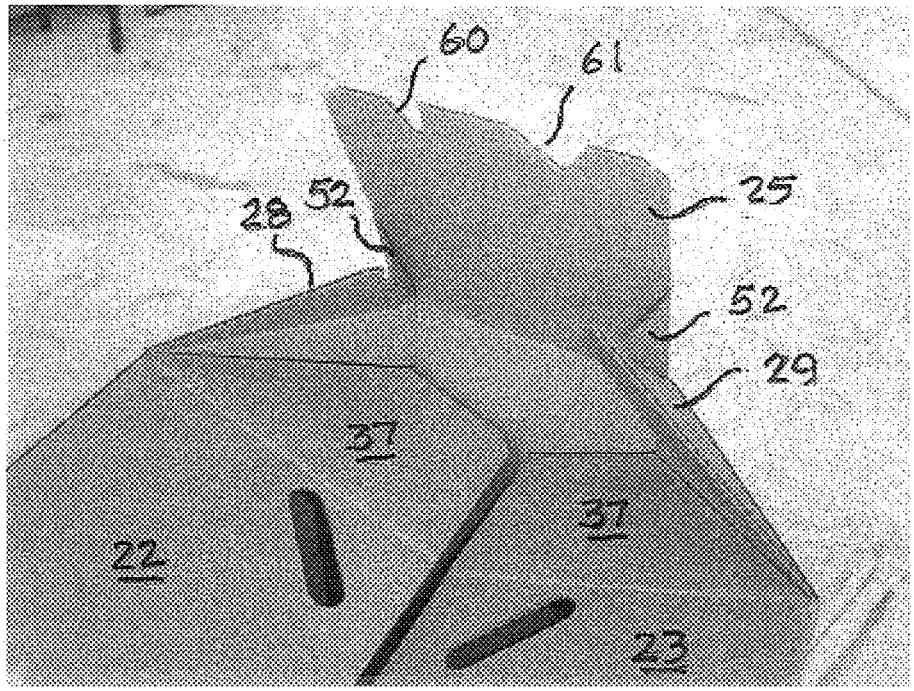
FIG. 7 is an enlarged fragmentary perspective view of a bin made from the blank of FIG. 4, with the bin inverted so that its bottom end is up, and showing the major flaps folded inwardly and one of the minor flaps and associated diagonal flaps being folded.
Figure 8:
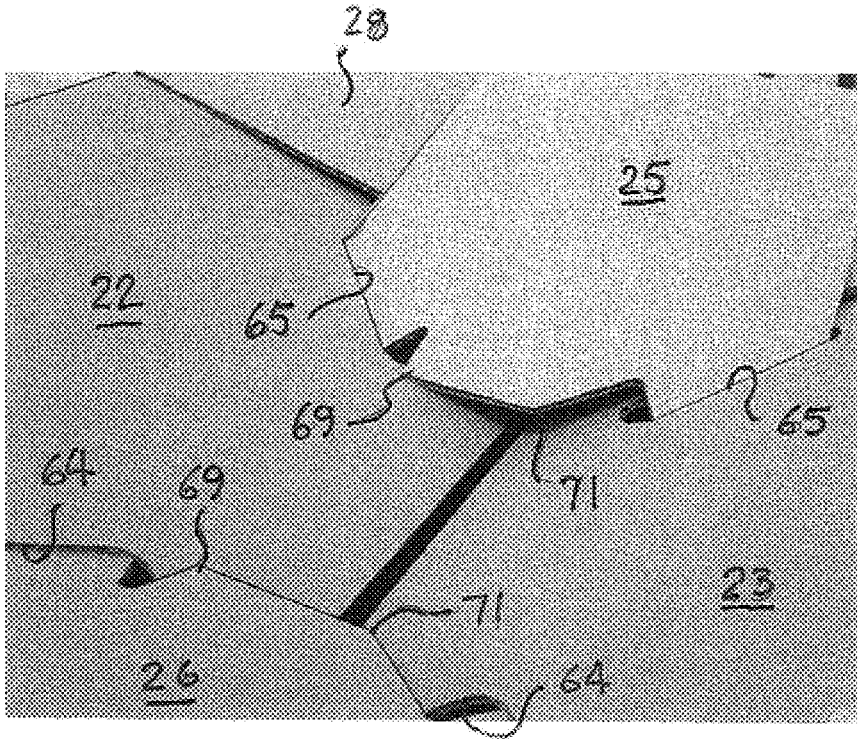
FIG. 8 is a further enlarged fragmentary perspective view of the bin of FIG. 7, showing how the minor flaps engage the major flaps during set up to insert the locking tabs into the slots, and illustrating how the shaped notches in the minor flaps act to provide clearance for one of the major flaps so that that flap can rise above the other flap.
Figure 9:
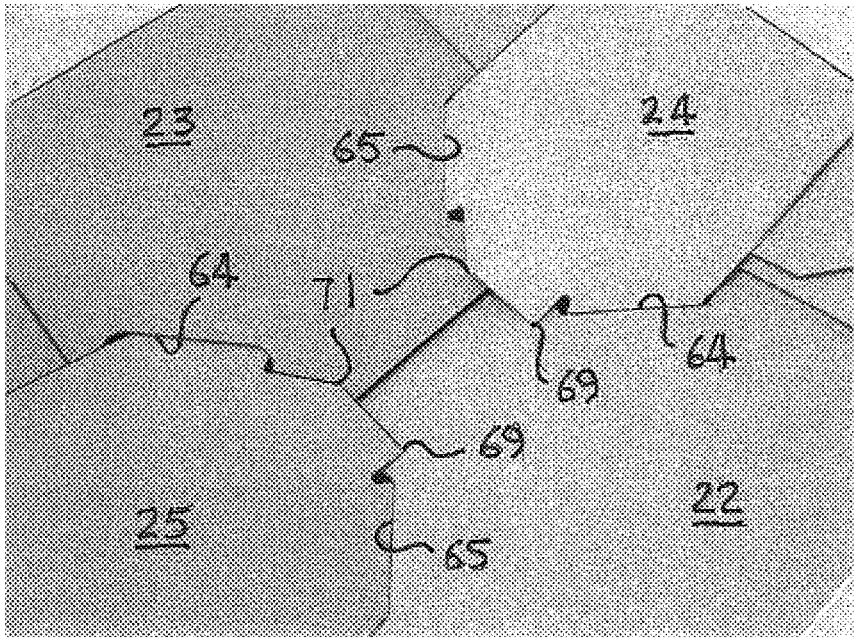
FIG. 9 is a view similar to FIG. 8, looking from the opposite end of the bin, and showing a further stage of the bin being set up, wherein one of the major bottom flaps is beginning to overlie the other as the flaps move toward a generally horizontal position.
Figure 10:
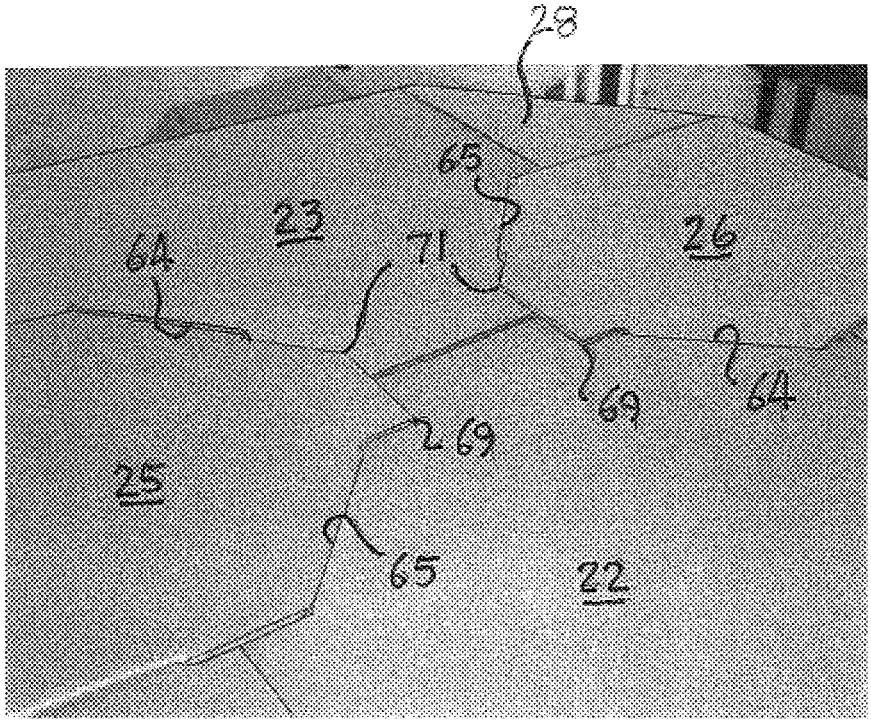
FIG. 10 is an enlarged fragmentary bottom perspective view of the bin of FIG. 9, with the flaps in their operative, overlapped horizontal position.
Figure 11:
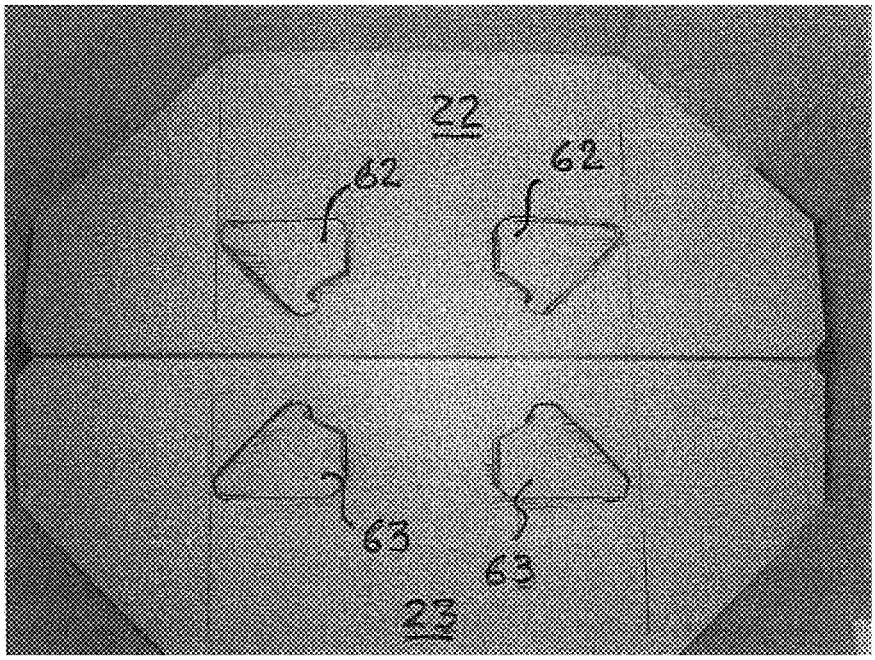
FIG. 11 is a plan view of the interior bottom of the bin of FIG. 10, showing the relatively flat interior bottom surface, with the only members projecting into the interior comprising the locking tabs.

To erect the bin, and with reference to that form shown in FIG. 4, it is placed in an inverted position with its bottom end up as seen in FIGS. 7-10. If desired, to aid in squaring up the bin and to prevent contamination of the top end of the bin, the inverted bin may be placed on a plastic pallet (not shown) as described in U.S. provisional application Ser. No. 60/712,236. The major bottom flaps 22 and 23 are first folded inwardly as seen in FIG. 7, followed by inward folding of the minor bottom flaps 25 and 26. The minor flaps are then pressed downwardly against the major flaps, causing the major flaps to move downwardly slightly into the bin to bring the locking tabs 62 and 63 into aligned registry with the slots 64 and 65. When downward pressure is released, the flaps spring back upwardly, with the tabs extending into the slots to interlock the flaps together in a generally horizontal position closing the bottom of the bin, as seen in FIG. 10. Inward folding of the major flaps is easily accomplished since they are free of connection with adjacent flaps, and inward folding of the minor flaps causes the diagonal flaps to automatically fold inwardly so that they are sandwiched between the major and minor flaps in a fully set up bin. Further, and as previously described, in a bin having overlapping bottom flaps the differently shaped notches in the end edge of the minor flaps causes one of the opposed major flaps to be held down slightly more than the other so that the flaps can easily move into overlapping relationship as they approach their horizontal positions.

Although particular embodiments of the invention are illustrated and described in detail herein, it is to be understood that various changes and modifications may be made to the invention without departing from the spirit and intent of the invention as defined by the scope of the appended claims.

What is claimed is:

1. An octagonal bulk bin comprising:

a pair of opposite sidewalls, a pair of opposite end walls, and opposed pairs of diagonal corner panels interposed between adjacent said sidewalls and end walls, wherein the sidewails, end walls and diagonal corner panels are joined to one another along vertical folds;

major bottom flaps foldably joined to bottom edges of the sidewalls along horizontal folds;

minor bottom flaps foldably joined to bottom edges of the end walls along horizontal folds;

diagonal bottom flaps foldably joined to bottom edges of the diagonal panels along horizontal folds;

cuts separating said major bottom flaps from respective adjacent diagonal bottom flaps, said cuts terminating in spaced relation to said horizontal folds to prevent initiation of tearing of said vertical folds; and a foldable web panel interconnecting opposite side edges of each minor bottom flap with adjacent side edges of respective adjacent diagonal bottom flap, each said web panel being defined by first and second divergent fold scores, wherein said first fold score extends in alignment with an adjacent vertical fold and an adjacent side edge of the minor bottom flap, and the second fold score extends to a free end edge of the diagonal bottom flap from a point on the first fold score spaced from the horizontal fold connecting the minor bottom flap to its associated end wall; and said web panel and a portion of an adjacent minor bottom flap are crushed.

2. An octagonal bulk bin as claimed in claim 1, wherein:

said cuts separating said major bottom flaps from respective adjacent diagonal bottom flaps terminate in a J-shape having a hooked end adjacent but spaced from an intersection of a said horizontal fold with a said vertical fold, said hooked end having a convex side adjacent said intersection and a free end in an adjacent major bottom flap pointing away from said intersection and into said major bottom flap to redirect stress away from said horizontal and vertical folds.

3. An octagonal bulk bin as claimed in claim 1, wherein:

at least a portion of each said diagonal bottom flap is crushed.

4. An octagonal bulk bin as claimed in claim 3, wherein:

said diagonal bottom flap and said web panel are crushed over their entire areas; and the portion of said adjacent minor bottom flap that is crushed has an arcuately shaped edge.

5. An octagonal bulk bin as claimed in claim 4, wherein:

the crushed area of the diagonal bottom flap comprises a first crushed area, and the crushed web panel and crushed portion of said adjacent minor bottom flap comprise a second crushed area, said first and second crushed areas being crushed to a different extent.

6. An octagonal bulk bin as claimed in claim 5, wherein:

said second crushed area is crushed to a greater extent than said first crushed area.

7. An octagonal bulk bin as claimed in claim 1, wherein:

a pair of spaced apart V-shaped notches are formed in an outer free edge of each minor bottom flap, forming a pair of spaced apart locking tabs on opposite corners of said outer free edge of each minor bottom flap; and a pair of spaced apart open slots are formed adjacent an outer free edge of each said major bottom flap in a position to be in aligned registry with respective said locking tabs when the major and minor bottom flaps are folded inwardly to closed position across the bottom of said bin, said locking tabs extending into said slots to lock the major and minor bottom flaps in their inwardly folded position.

8. An octagonal bulk bin as claimed in claim 7, wherein:

one of said V-shaped notches of each said pair of notches is shaped differently than the other notch.

9. An octagonal bulk bin as claimed in claim 8, wherein:

said V-shaped notches have divergent sides forming said V-shape, one of the sides of one of the notches of each pair diverging at a greater angle than the other notch of the pair.

10. An octagonal bulk bin comprising:

a pair of opposite sidewalls, a pair of opposite end walls, and opposed pairs of diagonal corner panels interposed between adjacent said sidewalls and end walls, wherein the sidewalls, end walls and diagonal corner panels are joined to one another along vertical folds;

major bottom flaps foldably joined to bottom edges of the sidewalls along horizontal folds;

minor bottom flaps foldably joined to bottom edges of the end walls along horizontal folds;

diagonal bottom flaps foldably joined to bottom edges of the diagonal corner panels along horizontal folds; and self locking means for locking said major and minor flaps and said diagonal corner flaps in closed position, said self locking means comprising a pair of notches in a free edge of each said minor bottom flap defining locking tabs at opposite outer corners of said free edge, and a pair of open slots near a free edge of each said major bottom flap in positions to receive the locking tabs when the flaps are folded to a closed position, said notches having divergent side edges defining a V-shape, and the divergent side edges of one notch of each pair diverging to a greater extent than the side edges of the other notch.

11. An octagonal bulk bin as claimed in claim 10, wherein:

a foldable web panel interconnects opposite side edges of each minor bottom flap with adjacent side edges of respective adjacent diagonal bottom flaps.

12. An octagonal bulk bin as claimed in claim 11, wherein:

said web panel and a portion of an adjacent minor bottom flap are crushed.

13. An octagonal bulk bin as claimed in claim 12, wherein:

at least a portion of each said diagonal bottom flap is crushed.

14. An octagonal bulk bin as claimed in claim 10, wherein:

said diagonal bottom flap and said web panel are crushed over their entire areas; and the portion of said adjacent minor bottom flap that is crushed has an arcuately shaped edge.

15. A blank for making an octagonal bulk bin, comprising:

a unitary piece of generally rectangularly shaped material having a plurality of first, parallel, spaced apart fold scores delimiting adjacent sidewall panels, end wall panels, and diagonal corner panels;

a second fold score extending perpendicular to the first fold scores and defining bottom edges of the sidewall panels, end wall panels and diagonal corner panels;

a bottom-forming flap panel joined to each said bottom edge at said second fold score, said bottom-forming flap panels including a major flap panel connected to the bottom edge of each sidewall panel, a minor flap panel connected to the bottom edge of each end wall panel, and a diagonal flap panel connected to the bottom edge of each diagonal corner panel, said major and minor flap panels having a first width from a free end edge thereof to their folded connection with an associated wall panel, and said diagonal flap panels having a second width from a free end edge thereof to their folded connection with an associated diagonal corner panel;

a cut separating each said major flap panel from an adjacent diagonal flap panel; and a web panel connecting opposite side edges of each minor flap panel with an adjacent side edge of a respective adjacent diagonal flap panel, each said web panel and an adjacent portion of a said minor flap panel being crushed.

16. A blank as claimed in claim 15, wherein:

at least a portion of said diagonal flap panel is crushed.

17. A blank for making an octagonal bulk bin, comprising:

a unitary piece of generally rectangularly shaped material having a plurality of first, parallel, spaced apart fold scores delimiting adjacent sidewall panels, end wall panels, and diagonal corner panels;

a second fold score extending perpendicular to the first fold scores and defining a bottom edge of the sidewall panels, end wall panels and diagonal corner panels;

a plurality of bottom-forming flap panels joined to the bottom edge at said second fold score, said bottom-forming flap panels including a major flap panel connected to the bottom edge of each sidewall panel, a minor flap panel connected to the bottom edge of each end wall panel, and a diagonal flap panel connected to the bottom edge of each diagonal corner panel, said major and minor flap panels having a first width from a free end edge thereof to their folded connection with an associated wall panel, and said diagonal flap panels having a second width from a free end edge thereof to their folded connection with an associated diagonal corner panel;

a cut separating each said major flap panel from an adjacent diagonal flap panel; and self locking means on said minor flap panels and major flap panels to lock said panels in closed position, said locking means comprising a pair of notches on a free end edge of each minor flap panel, defining a pair of locking tabs, and a pair of open slots near a free end edge of each major flap panel in positions to receive the locking tabs, said notches having divergent side edges defining a V-shape, and the divergent side edges of one notch of each air diver in to a greater extent than the side edges of the other notch.

18. A blank as claimed in claim 17, wherein:

a web panel connects opposite side edges of each minor flap panel with an adjacent side edge of a respective adjacent diagonal flap panel, said diagonal flap panel, said web panel, and an adjacent portion of an adjacent minor flap panel being crushed.

19. An octagonal bulk bin comprising:

a pair of opposite sidewalls, a pair of opposite end walls, and opposed pairs of diagonal corner panels interposed between adjacent said sidewalls and end walls, wherein the sidewalls, end walls and diagonal corner panels are joined to one another along vertical folds;

major bottom flaps foldably joined to bottom edges of the sidewalls along horizontal folds;

minor bottom flaps foldably joined to bottom edges of the end walls along horizontal folds;

diagonal bottom flaps foldably joined to bottom edges of the diagonal corner panels along horizontal folds;

a web panel connected between opposite side edges of each minor flap panel and an adjacent side edge of a respective adjacent diagonal flap panel, each said web panel being triangularly shaped and delimited by first and second divergent fold scores and a curvilinear free end edge, wherein said first fold score extends in alignment with an adjacent said vertical fold and an adjacent side edge of a said minor bottom flap, and the second fold score extends to a free end edge of the diagonal bottom flap from a point on the first fold score spaced from the horizontal fold connecting the minor bottom flap to its associated end wall; and said web panel and a portion of an adjacent minor bottom flap are crushed.

20. A bulk bin as claimed in claim 19, wherein:

said mirror image portion has one side edge defined by said first fold score, a second side edge defined by a score in said minor flap panel extending divergently from said first fold score, and an arcuate end edge.

21. A bulk bin as claimed in claim 20, wherein:

said curvilinear end edge of said web panel is concave and said arcuate end edge of said mirror image portion is convex.

22. A bulk bin as claimed in claim 21, wherein:

each said diagonal bottom flap defines a first area and each said web panel and adjacent mirror image portion together define a second area, said first and second areas being crushed and said first area being crushed to a lesser extent than said second area.

* * * * *

UNITED STATES PATENT AND TRADEMARK OFFICE

CERTIFICATE OF CORRECTION

PATENT NO. : 7,654,440 B2
APPLICATION NO. : 11/512864
DATED : February 2, 2010
INVENTOR(S) : Benjamin W. Quaintance et al.

It is certified that error appears in the above-identified patent and that said Letters Patent is hereby corrected as shown below:

In the claims,

Claim 17, Column 12, line 52 should be corrected as shown herein below:

"air diver in" should read --pair diverging--

Signed and Sealed this
Seventeenth Day of November, 2015

Michelle K. Lee

Michelle K. Lee
*Director of the United States Patent and Trademark Office*